US009903174B2

(12) United States Patent
Nguyen et al.

(10) Patent No.: US 9,903,174 B2
(45) Date of Patent: Feb. 27, 2018

(54) TORQUE-PROVIDER

(75) Inventors: Dennis P. Nguyen, Pearland, TX (US); Christy L. Petter, Houston, TX (US)

(73) Assignee: Cameron International Corporation, Houston, TX (US)

( * ) Notice: Subject to any disclaimer, the term of this patent is extended or adjusted under 35 U.S.C. 154(b) by 1737 days.

(21) Appl. No.: 12/866,060

(22) PCT Filed: Mar. 18, 2009

(86) PCT No.: PCT/US2009/037493

§ 371 (c)(1),
(2), (4) Date: Aug. 4, 2010

(87) PCT Pub. No.: WO2009/117478

PCT Pub. Date: Sep. 24, 2009

(65) Prior Publication Data

US 2010/0326674 A1 Dec. 30, 2010

Related U.S. Application Data

(60) Provisional application No. 61/037,951, filed on Mar. 19, 2008.

(51) Int. Cl.

| | |
|---|---|
| ***E21B 33/04*** | (2006.01) |
| ***E21B 33/035*** | (2006.01) |
| ***E21B 33/068*** | (2006.01) |

(52) U.S. Cl.

CPC ..... *E21B 33/0415* (2013.01); *E21B 33/0355* (2013.01); *E21B 33/0422* (2013.01); *E21B 33/068* (2013.01)

(58) Field of Classification Search

CPC ..... E21B 33/0415; E21B 33/0355; E21B 33/0422; E21B 33/068; E21B 33/04; E21B 33/03; E21B 19/00

USPC ..... 166/78.1, 117.7, 381, 85.1, 379, 85.5

See application file for complete search history.

(56) References Cited

U.S. PATENT DOCUMENTS

| | | | | |
|---|---|---|---|---|
| 2,630,181 | A * | 3/1953 | Solum | E21B 19/00 166/78.1 |
| 4,597,448 | A * | 7/1986 | Baugh | 166/348 |
| 4,719,978 | A | 1/1988 | Klemm | |
| 5,388,639 | A | 2/1995 | Betchan et al. | |

(Continued)

OTHER PUBLICATIONS

For the American Heritage Dictionary definition: into. (n.d.) The American Heritage® Dictionary of the English Language, Fourth Edition. (2003). Retrieved Feb. 11, 2013 from http://www.thefreedictionary.com/into.*

(Continued)

*Primary Examiner* — Wei Wang
(74) *Attorney, Agent, or Firm* — Chamberlain Hrdlicka

(57) ABSTRACT

An assembly for providing torque to an object in a wellhead. The assembly includes a body attachable to the wellhead and including a bore with a centerline. The body further includes a first set of pistons within cylinders oriented at angles offset from and perpendicular to the centerline of the bore. The pistons are moveable within the cylinders between a retracted position and an extended position where the pistons are extended into the body bore. The movement of the pistons between the retracted and extended positions imparts a linear force capable of rotating the object in the wellhead in a first direction.

26 Claims, 5 Drawing Sheets

(56) References Cited

U.S. PATENT DOCUMENTS

| | | | |
|---|---|---|---|
| 5,427,178 | A | 6/1995 | Bland |
| 5,429,188 | A | 7/1995 | Cameron et al. |
| 2004/0065434 | A1 | 4/2004 | Bland |

OTHER PUBLICATIONS

Examination Report dated Oct. 21, 2011 for corresponding GB Application No. 1014638.9 filed Mar. 18, 2009.
Examination Report dated Feb. 15, 2012 for corresponding GB Application No. 1014638.9 filed Mar. 18, 2009.
Examination Report dated Jun. 22, 2012 for corresponding GB Application No. 1014638.9 filed Mar. 18, 2009.
PCT/US2009/037493 International Search Report and Written Opinion, dated Oct. 15, 2009 (11 p.).

* cited by examiner

TORQUE-PROVIDER

CROSS-REFERENCE TO RELATED APPLICATIONS

This application is a 35 U.S.C. § 371 national stage application of PCT/US2009/037493 filed 18 Mar. 2009, which claims the benefit of U.S. Provisional Patent Application No. 61/037,951 filed 19 Mar. 2008, both of which are incorporated herein by reference in their entireties for all purposes.

STATEMENT REGARDING FEDERALLY-SPONSORED RESEARCH OR DEVELOPMENT

Not applicable.

BACKGROUND

Wellheads are used in oil and gas drilling to suspend casing strings, seal the annulus between casing strings, and provide an interface with the blowout preventer ("BOP"), for example. The design of a wellhead is generally dependent upon the location of the wellhead and the characteristics of the well being drilled or produced.

In drilling the well, it is conventional to pass a number of concentric tubes (e.g., casing strings, tubing strings, etc.) down the well to support the borehole and/or segregate the borehole into annular zones. Typically, an outermost casing (i.e., conductor) is fixed in the ground, and the inner casings (e.g., casing, production casing, production tubing) are each supported from the next outer casing or by the wellhead. The wellhead is thus used to support a number of hangers that support the weight of the casing. In certain instances, it is desirable to apply torque to a downhole hanger or tool. Unfortunately, traditional torque-applying tools are typically bulky and difficult to position over the hanger, for instance. Moreover, traditional tools obstruct the borehole when installed, thus precluding full-bore access.

Hangers also use seal assemblies to seal the annuli between the hangers and the wellhead. However, the seals as well as the casing itself are subject to forces throughout the life of the well that might cause the hanger to unseat and potentially compromise the seal between the casing hanger and the wellhead, for example. Thus, the seals used with hangers must be restrained from movement when subjected to force. The seal assemblies typically include robust bodies including both inner and outer seals that are set upon by applying actuation torque from a tool above the seal assembly. Typically, because the torque is applied from above the seal assembly, the actuator tool may only access one portion of the seal assembly to apply the actuation torque. Thus, usually both the inner and outer seals of the seal assembly are set simultaneously. In some situations, however, the inner and outer seals require different amounts of force to be set and thus simultaneous actuation constrains the ability to properly form a seal against the wellhead.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1A:
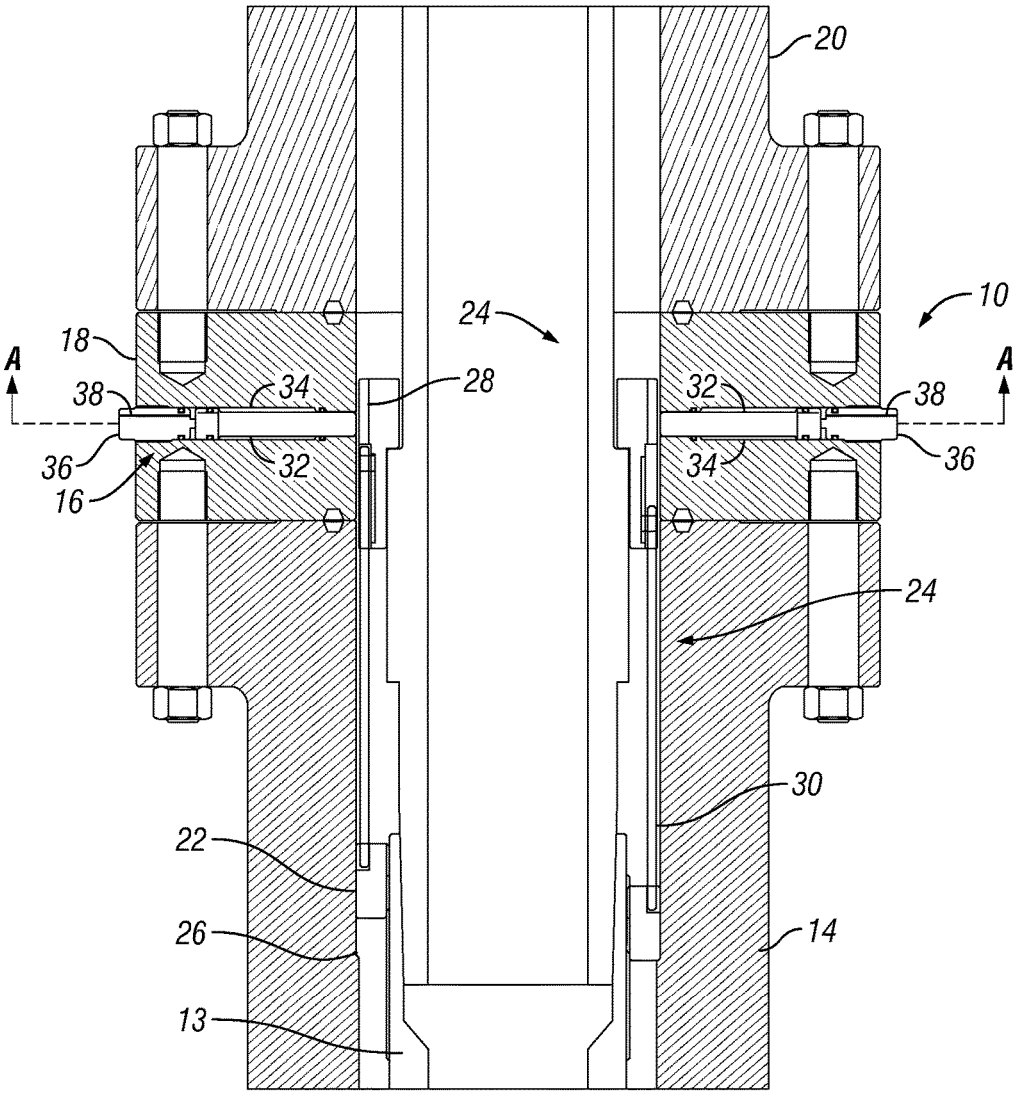
FIG. 1A is a cross section of casing in a wellhead with an adjustable hanger being installed using an exemplary torque-provider assembly, wherein the left portion illustrates an over-pulled position and the right portion illustrates the installed position.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Figure 1B:
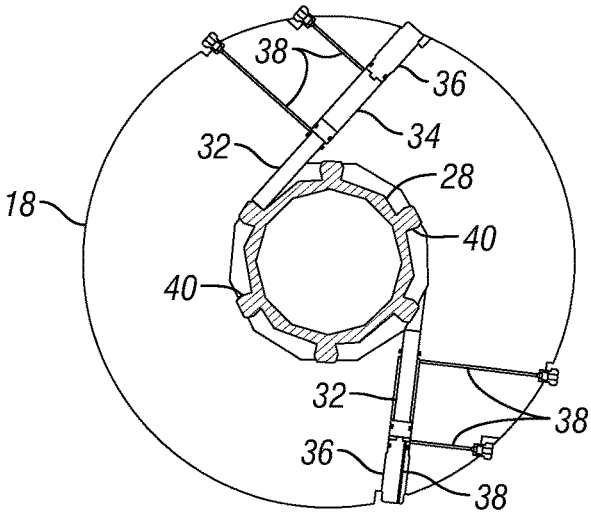
FIG. 1B is a view of the torque-provider assembly taken from plane A-A of FIG. 1A.

FIGS. 1A-B show a torque-provider assembly 10 used to install a casing string supported by a casing hanger 13 in a wellhead 14 that includes a wellhead bore. The torque-provider assembly 10 includes at least one set of torque-provider pistons 16 located in a BOP adapter 18 installed between the wellhead 14 and a BOP 20. The torque-provider assembly 10 may be secured using the connectors as shown, and it is appreciated that any other suitable connector may also be used. It is also appreciated, however, that the piston set 16 may be located in other structural components, such as the wellhead or BOP flanges, for example.

Typically, a well is drilled by passing drill string through a wellhead and an attached BOP. Attached to the end of the drill string is a drill bit for creating the wellbore. As the wellbore is extended deeper, from time to time, the borehole must be supported from collapse or must be isolated from a fluid producing formation, for example. The drill string and drill bit are typically removed, and a tubular casing string (not shown) is run into the well to the desired depth. The weight of the casing is supported by a casing hanger 13, which is secured to the upper end of the casing string and is supported by the wellhead 14. In the example shown in FIGS. 1A-B, the casing hanger 13 is an adjustable casing hanger that includes an adjustable landing ring 22. The adjustable landing ring 22 rotates relative to the casing hanger 13 on threads to adjust the vertical position of the landing ring 22 relative to the casing hanger 13 body. As is shown, this threaded arrangement allows for relative vertical displacement between the casing hanger's body and the landing ring 22. As a result, the tensioning of the casing string can be adjusted without changing the landing location of a landing shoulder, for example, on the wellhead 14. In the illustrated embodiment, the adjustable casing hanger is run into an over-pulled position, at which time the torque-provider assembly 10 can be actuated to adjust the position of the landing ring 22 with respect to the casing hanger's body. Once adjusted, the casing hanger is lowered into its installed position, with the landing ring 22 engaging a landing shoulder 26 to support the casing hanger 13.

FIG. 1A is a split view showing the casing hanger 13 and casing string being run into the wellhead 14 using a casing hanger running tool 24, as described above. The illustrated casing hanger running tool 24 is secured to the casing hanger 13, as would be appreciated by those of ordinary skill in the art. On the left, FIG. 1A shows the landing ring 22 before it is positioned for the wellhead landing shoulder 26. On the right, FIG. 1A shows the landing ring 22 positioned and landed on the landing shoulder 26.

To position the landing ring 22, the casing hanger running tool 24 includes a torque ring 28 and an energizing ring 30 that are used to transfer torque from the torque-provider piston set 16 to rotate the landing ring 22. The torque-provider assembly 10 provides torque in a direction perpendicular to the longitudinal axis of the casing string 12. As shown in FIG. 1A, the torque-provider assembly 10 becomes essentially a horizontal torque-provider that provides torque to actuate and set the landing ring 22. Thus, unlike some prior systems that require vertical access to the seal assembly, the torque-provider assembly 10 allows "horizontal" access to the landing ring 22 and does not require the positioning of a separate torque providing tool above the wellhead 14. Moreover, the illustrated torque-provider assembly 10 provides full-bore access even when the torque-provider assembly 10 remains installed on the wellhead 14. Thus, the torque-provider can mitigate expenses related to removal and reinstallation time, should the application of torque become later required.

As shown in FIGS. 1A-B, the torque-provider assembly 10 includes a single torque-provider piston set 16 that is hydraulically-powered to actuate pistons 32 and produce a rotational force on the landing ring 22. The pistons 32 travel within cylinders 34 that are closed at their outer end with seal plugs 36. Hydraulic lines (not shown) connect to the outside of the seal plugs 36 or to the BOP adapter 18 for providing hydraulic fluid pressure to the pistons 32 though seal plug ports 38 in the pistons 32 or the BOP adapter 18. During actuation, the pistons 32 cycle between a retracted position to an extended position as hydraulic fluid pressure is applied and then retracted from the cylinders 34. Also, as shown in FIG. 1B, the pistons 32 are positioned around and are angled to engage the torque ring 28 at torque ring stops 40. Thus, as each piston 32 extends, it engages a ring stop 40, applying torque to the torque ring 28. Unless restrained, the torque ring 28 rotates until the piston 32 is fully extended. The piston 32 then retracts and another piston 32 is extended to engage another ring stop 40 to further rotate the torque ring 28. Depending on the application, the torque-provider 10 may also extend more than one piston 32 at the same time to engage ring stops 40 to apply higher amounts of torque or for possibly applying the final make-up torque for the torque ring 28.

Figure 1C:
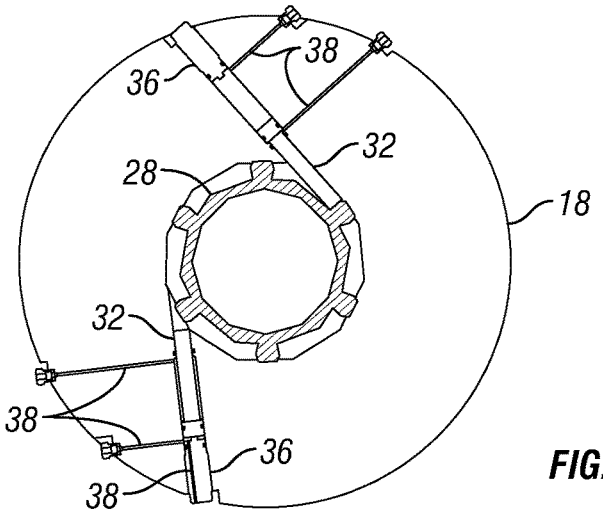
FIG. 1C is a view of an alternative and exemplary embodiment of a torque-provider assembly taken from plane A-A of FIG. 1A and showing a reverse orientation.
Figure 1D:
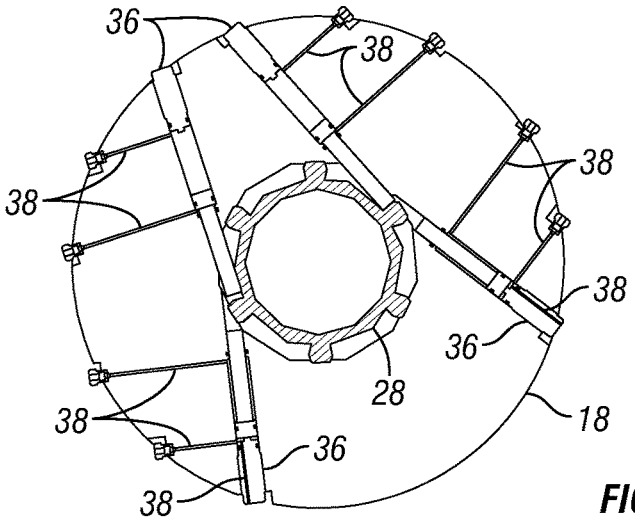
FIG. 1D is a view of another alternative torque-provider assembly taken from plane A-A of FIG. 1A and showing a combination of advancing and reverse-orientation pistons.
Figure 2A:
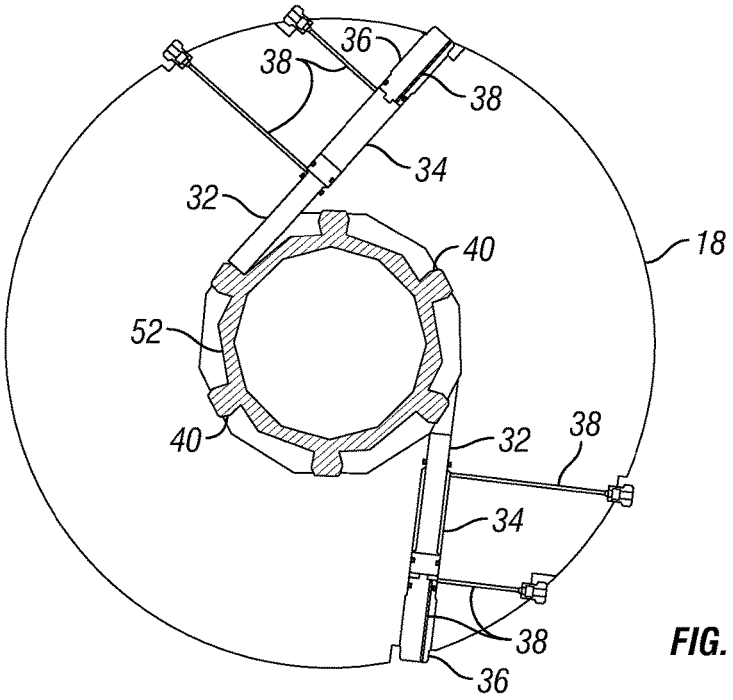
FIG. 2A is a view of the torque-provider assembly taken from plane A-A of FIG. 2B.
Figure 2B:
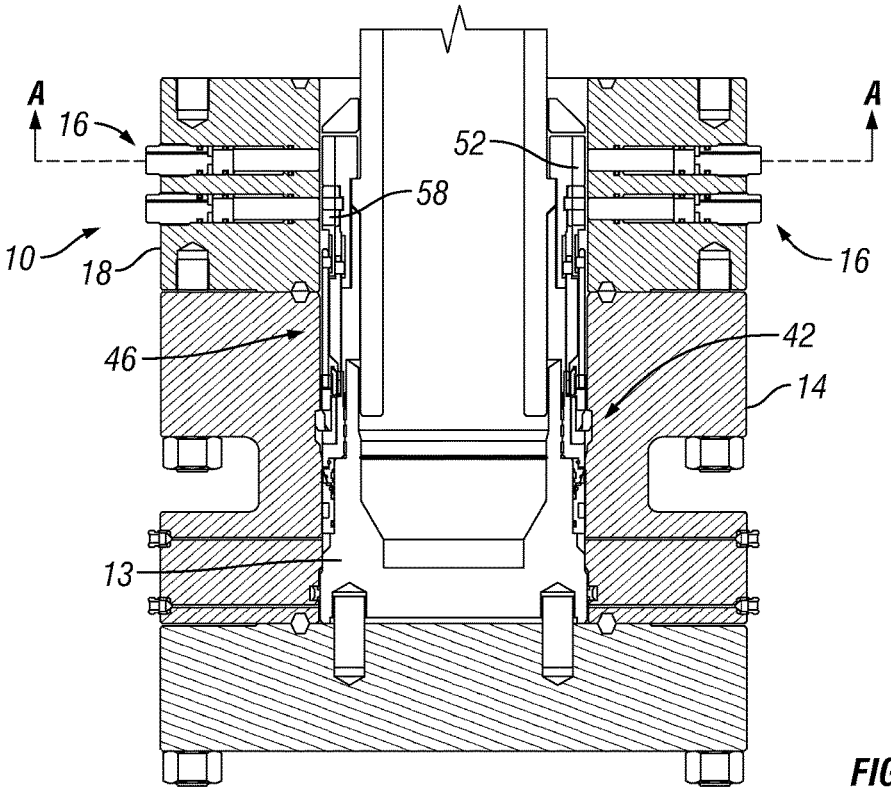
FIG. 2B is a cross section of an example seal assembly shown being installed on a plug casing hanger.

Although described as hydraulic, it is appreciated that power may be provided by other means, even including providing power manually. It should also be appreciated that the piston set 16 may be any suitable configuration for providing torque to the landing ring 22 and may be actuated by a number of suitable means, including manual actuation or motorized actuation. Also, although shown with only one torque-provider piston set 16, the torque-provider assembly 10 may also include more than one offset torque-provider piston set 16. The piston set 16 may also include pistons 32 oriented for reverse rotation as shown in FIG. 1C. Alternatively, the reverse pistons 32 may be combined with the advancing pistons 32 as shown in FIG. 1D. Also, the reverse orientation pistons 32 may be a second, offset piston set 16 such as shown in FIG. 2B and described further below. With the reverse orientation, the pistons 32 may be used to both land and unseat the landing ring 22. Additionally, the reverse orientation piston set 16 may be obtained by uninstalling the torque-provider assembly 10, turning the assembly 10 over, and then reinstalling the torque-provider assembly 10.

Referring again to FIG. 1A, the torque ring 28 is supported for rotation around the hanger running tool 24 but does not move axially when rotated. The torque ring 28 engages the energizing ring 30 in a key-in-groove arrangement such that rotating the torque ring 28 rotates the energizing ring 30 while allowing the energizing ring 30 to move axially. In addition, the energizing ring 30 engages the landing ring 22 in a tongue-and-groove arrangement such that rotation is transferred from the energizing ring 30 to the landing ring 22. The torque-provider assembly 10 may thus be used to rotate the landing ring 22. Rotation of the landing ring 22 moves the landing ring 22 in the direction of the landing shoulder 26 until the landing ring 22 is properly positioned, at which point the landing ring 22 lands on the shoulder 26 as shown on the right side of FIG. 1A. The casing hanger 13 may now be supported by the wellhead 14 and the casing hanger running tool 24, including the torque ring 28 and energizing ring 30, may be removed from the wellhead 14 with the casing 12 and casing hanger 13 remaining installed in the wellhead 14. The casing hanger running tool 24 may detach from the casing hanger 13 by any suitable method, such as rotating the casing hanger running tool 24 relative to the casing hanger 13 to release pins from a groove in the casing hanger 13. It is appreciated that other connections between the casing hanger running tool 24 and the casing hanger 13 may also be used. With the casing and casing hanger 13 installed and the casing hanger running tool 24 removed, a seal assembly may be installed or other drilling operations may commence.

Casing hangers typically use seal assemblies to form a seal between the outside of the casing hanger and the wellhead. As a further example of how the torque-provider assembly 10 may be used, FIGS. 2A and 2B show a seal assembly 42 that may be used to provide a metal-to-metal seal between the wellhead 14 and a plug casing hanger 13. It is appreciated though that the seal assembly 42 may be used to seal off an actual casing hanger 13 and that seals other than a metal-to-metal seal may also be used under appropriate conditions.

FIGS. 2A and 2B show a torque-provider assembly 10 used to set the seal assembly 42 that is run into the wellhead 14 using a seal assembly running tool 46. The torque-provider assembly 10 includes a BOP adapter 18 and torque-provider piston sets 16 that are secured onto the wellhead 14.

The torque-provider assembly 10 provides torque in a direction perpendicular to the longitudinal axis of the seal assembly running tool 46. Thus, similarly to FIGS. 1A-C, the torque-provider assembly 10 becomes essentially a horizontal torque-provider that provides torque to actuate and set the seal assembly 42. Thus, unlike some prior systems that require vertical access to the seal assembly, the torque-provider assembly 10 allows "horizontal" access to the seal assembly 42. The torque-provider assembly 10 may thus provide torque to the seal assembly 42 in different locations, in different amounts, and at different times if desired, which would not be possible with typical previous "vertical" access torque-providers.

In the example shown in FIGS. 2A and 2B, the torque-provider assembly 10 includes two piston sets 16. For convenience, the piston sets 16 are described as a first, or "upper," piston set 16 and a second, or "lower," piston set 16. It is appreciated that upper and lower piston sets 16 may be any suitable configuration for providing torque to the seal assembly 42. For example, as shown and as previously described, the piston sets 16 are hydraulically-powered to actuate pistons 32 and produce a rotational force on the seal assembly 42. However, torque may be provided by other means, even including providing torque manually. Also, although shown with two piston sets 16, the torque-provider assembly 10 may include any number of piston sets 16 depending on the design of the seal assembly 42.

As shown in FIGS. 2A and 2B, the seal assembly 42 is designed to form a seal in the annulus between the casing hanger 13 and the wellhead 14. To do so, the seal assembly 42 includes a seal that forms an inner and outer seal contemporaneously by applying axial compression to expand the seal radially. However, it is appreciated that the seal may also be configured to set an inner seal and outer seal at different times.

The seal assembly 42 includes nested sleeves, or rings, that rotate on threads to provide the axial compression for setting the seal. As shown in FIG. 2B, the torque-provider assembly transfers torque to the seal assembly 42 through the seal assembly running tool 46 that includes an upper torque ring 52 supported for rotation on the seal assembly running tool 46 without relative axial movement. As shown, the upper piston set 16 provides torque to the upper torque ring 52, which in turn rotates another ring that rotates on threads to compress and set the seal between the plug casing hanger 13 and the wellhead 14.

Once the seal is set, the upper piston set 16 may be deactivated to stop applying torque to the upper torque ring 52. The lower piston set 16 may then be activated to lock the seal as well as lock the seal assembly 42 to the wellhead 14. As shown, the seal assembly running tool 46 further includes a lower torque ring 58. Similarly to the upper piston set 16, the lower piston set 16 rotates the lower torque ring 58 without relative axial movement to the tool 46. The lower torque ring 58 is likewise similar to the upper torque ring in that it is engaged with and thus is able to rotate additional rings on threads for axial movement. For example, the lower torque ring 58 drives rings to engage a securing mechanism for locking the seal assembly 42 in place in the wellhead 14. The lower torque ring 58 also uses reverse thread mechanisms to lock the securing mechanism and the seal in place.

Figure 3A:
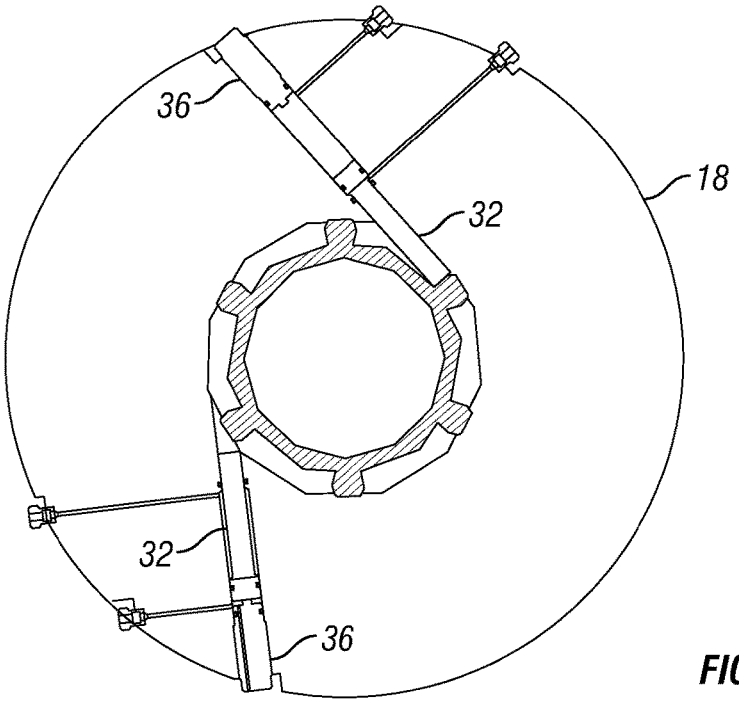
FIG. 3A is a view of the torque-provider assembly taken from plane B-B of FIG. 3B.
Figure 3B:
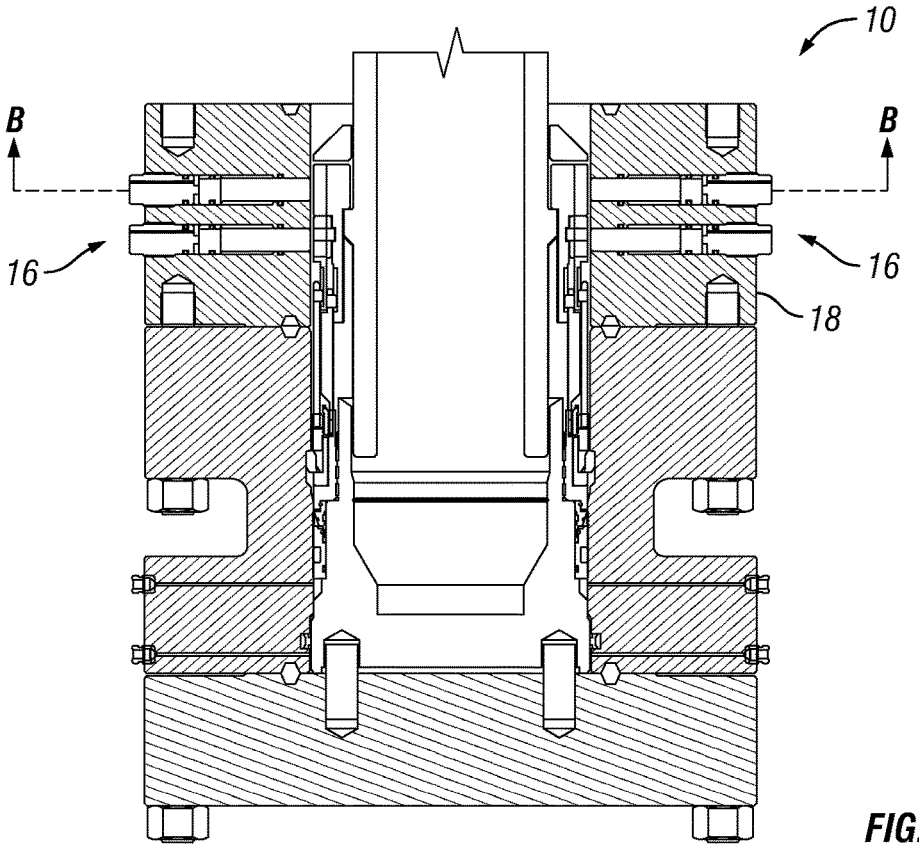
FIG. 3B is a cross section of an example seal assembly shown being uninstalled from the plug casing hanger and showing torque pistons configured for reverse rotation.
Figure 4A:
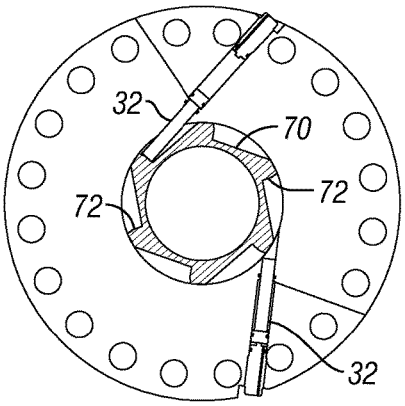
FIGS. 4A-4F show an actuation sequence of the torque-provider assembly.
Figure 4D:
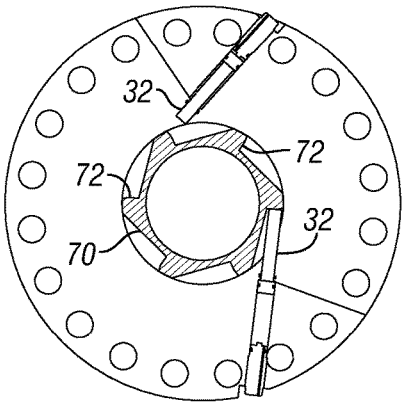
Figure 4B:
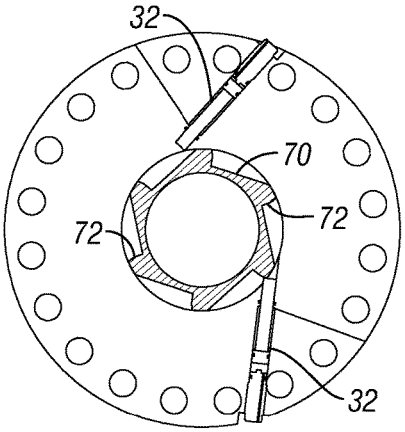
Figure 4E:
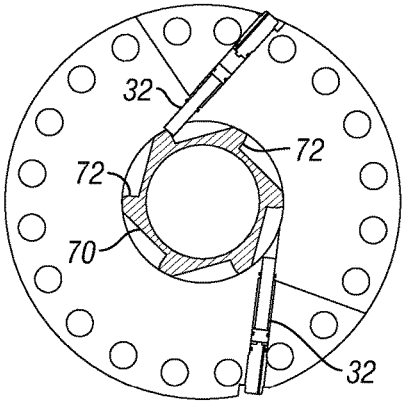
Figure 4C:
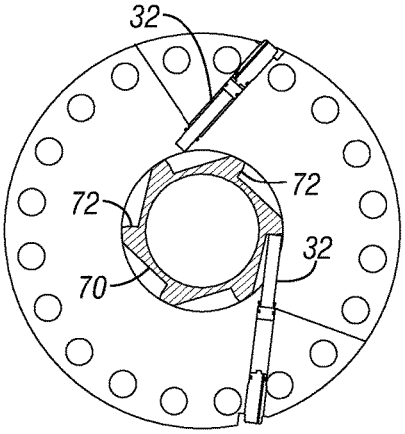
Figure 4F:
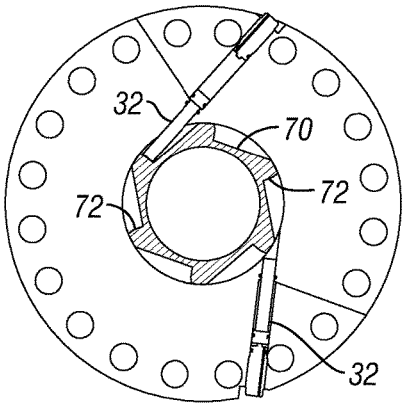

With the inner and outer seals set and the seal assembly 42 locked to the wellhead 14, the seal assembly running tool 46 may be removed. As shown in FIGS. 3A and 3B, should the seal assembly 42 need to be removed, the torque-provider assembly 10 may include, or be replaced with piston sets 16 with pistons 32 oriented to rotate the upper and lower torque rings 52, 58 in the opposite direction, thus disengaging the seal assembly 42 to unset the seal. The seal assembly 42 may then be removed from the wellhead 14. Although shown as separate from the piston sets 16 in FIGS. 2A-B, it is appreciated that the reverse orientation pistons 32 may be included with the advancing pistons 32 in the same piston sets 16. As previously mentioned, torque-provider assembly 10 may also be turned upside down to reverse the orientation of the pistons 32 to create reverse rotation torque.

As described above and shown in FIGS. 4A-4F, the torque-provider assembly 10 includes piston sets 16 that include more than one piston 32 acting on a torque ring 70. FIGS. 4A-4F illustrate the actuation process of the pistons 32 on a unidirectional torque ring 70. As shown, the pistons 32 are operated in alternating fashion to engage ring stops 72. After one piston 32 is extended, it is retracted to provide clearance for another piston 32 to extend and thus further rotated the torque ring 70. The process is repeated until the torque ring 70 is rotated to its desired position. However, more than one piston may be extended simultaneously for applying an increased amount of torque such as for applying the final make-up torque for a desired application. Although shown with only two pistons 32, each piston set 16 may include more than two pistons 32 oriented to rotated the torque ring 70 in the same direction. Also, as described previously, the torque ring 70 may instead be a bi-direction torque ring with bi-directional torque ring stops as shown in FIGS. 2A and 3A. In such an embodiment, there may be more than one offset piston set 16 with the piston sets acting to rotate the torque ring in different directions. Alternatively, a single piston set 16 may include pistons 32 in the same set that are oriented to rotate the torque ring in opposite directions. It is appreciated that these embodiments of piston sets 16 and torque rings are also applicable to each of the embodiments shown in FIGS. 1A-3B.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A casing installation system for installing casing in a wellhead including a bore, the casing supported by a casing hanger, the system including:

a seal assembly locatable within the wellhead bore surrounding the casing hanger and settable by axial movement relative to the wellhead bore;

a torque provider assembly including:

a body including a bore, the body bore including a centerline and alignable with the wellhead bore;

the body further including a first set of pistons within cylinders oriented at angles offset from and perpendicular to the centerline of the bore; and the pistons being moveable between a retracted position and an extended position where the pistons are extended within the body bore;

where the pistons moving between the retracted and extended positions rotate at least a portion of the seal assembly in a first direction to set the seal assembly axially while maintaining the position of the body relative to the wellhead.

2. The system of claim 1, where the torque provider assembly is attachable to the wellhead upside down such that at least a portion of the seal assembly is rotatable in a second direction.

3. The system of claim 1, where the set of pistons further includes pistons oriented to rotate at least a portion of the seal assembly in a second direction.

4. The system of claim 1, further including more than one set of pistons arranged in planes of the body spaced apart along the bore centerline.

5. The system of claim 4, where the sets of pistons are arranged with a set oriented to rotate at least a portion of the seal assembly in the first direction and a set oriented to rotate at least a portion of the seal assembly in a second direction.

6. The system of claim 4, where the sets of pistons are oriented to rotate at least a portion of the seal assembly in the same direction.

7. The system of claim 4, where the sets of pistons and the pistons within each set are independently operable.

8. The system of claim 1, where the pistons are moveable between the retracted and extended positions using fluid pressure.

9. A method of providing torque to an object in a wellhead including a bore including:

attaching a body to the wellhead, the body including a bore with a centerline, such that the body bore is aligned with the wellhead bore, the body further including a set of pistons; and imparting a linear force in a plane perpendicular to the centerline of the body and at angles offset to the centerline of the body bore by moving one of the pistons between a retracted position and an extended position where the piston is extended into the body bore to rotate at least a portion of the object in the wellhead in a first direction and to move the at least portion of the object in the wellhead in a direction axially parallel to the centerline of the body bore while maintaining the position of the body relative to the wellhead.

10. The method of claim 9, where imparting a linear force includes moving more than one of the pistons between the retracted position and the extended position where the pistons are extended into the body bore.

11. The method of claim 10, further including operating the pistons independently.

12. The method of claim 10, where imparting a linear force further includes imparting a linear force to rotate at least a portion of the object in the wellhead in a second direction using pistons in the set of pistons being oriented to rotate the object in the second direction.

13. The method of claim 10, where imparting a linear force includes moving pistons in more than one set of pistons arranged in planes of the body spaced apart along the bore centerline.

14. The method of claim 13, further including moving the pistons in a set to rotate the object in the first direction and moving the pistons in another set to rotate the object in a second direction.

15. The method of claim 13, further including moving the pistons to rotate the object in the same direction.

16. The method of claim 13, further including operating the sets of pistons and the pistons within each set independently.

17. The method of claim 10, further including attaching the body to the wellhead upside down such that the object in the wellhead is rotatable in a second direction.

18. An assembly for providing torque to an object in a wellhead, the assembly including:

a body removably attachable to the wellhead and including a bore, the bore including a centerline;

the body further including a first set of pistons within cylinders oriented at angles offset from and perpendicular to the centerline of the body bore;

the pistons being moveable between a retracted position and an extended position where the pistons are extended within the body bore; and where the pistons moving between the retracted and extended positions rotates the object in the wellhead in a first direction and moving the object in the wellhead in a direction axially parallel to the centerline of the body bore while the position of the body relative to the wellhead is maintained.

19. The assembly of claim 18, where the pistons are moveable between the retracted and extended positions using fluid pressure.

20. The assembly of claim 18, where the pistons are independently operable.

21. The assembly of claim 18, where the body is attachable to the wellhead upside down such that the object in the wellhead is rotatable in a second direction.

22. The assembly of claim 18, where the set of pistons further includes pistons oriented to rotate the object in a second direction.

23. The assembly of claim 18, further including more than one set of pistons arranged in planes of the body spaced apart along the bore centerline.

24. The assembly of claim 23, where the sets of pistons are oriented to rotate the object in the same direction.

25. The assembly of claim 23, where the sets of pistons are arranged with a set oriented to rotate the object in the first direction and a set oriented to rotate the object in a second direction.

26. The assembly of claim 23, where the sets of pistons and the pistons within each set are independently operable.

* * * * *